United States Patent [19]

Boltrek

[11] Patent Number: 4,580,675

[45] Date of Patent: Apr. 8, 1986

[54] TRANSPORTATION APPARATUS

[75] Inventor: Henry Boltrek, Freeport, N.Y.

[73] Assignee: Westinghouse Electric Corp., Pittsburgh, Pa.

[21] Appl. No.: 532,427

[22] Filed: Sep. 15, 1983

[51] Int. Cl.[4] ..... B66B 21/00; B66B 23/06

[52] U.S. Cl. ..... 198/331; 73/862.19

[58] Field of Search ..... 198/331, 335, 336, 337, 198/326, 781; 73/162, 862.19, 862.21

[56] References Cited

U.S. PATENT DOCUMENTS

| | | | |
|---|---|---|---|
| 2,211,427 | 8/1940 | Margles | 198/331 |
| 3,568,813 | 3/1971 | Schaeffer et al. | 198/335 |
| 3,651,919 | 3/1972 | Vollmer | 198/331 |
| 4,231,452 | 11/1980 | Kraft | 198/854 |

FOREIGN PATENT DOCUMENTS

| | | | |
|---|---|---|---|
| 1123362 | 5/1982 | Canada | 198/326 |

OTHER PUBLICATIONS

Sturtevant Quality, "Torque Manual", Addison, Illinois (1957).

*Primary Examiner*—Joseph E. Valenza
*Assistant Examiner*—Daniel R. Alexander
*Attorney, Agent, or Firm*—D. R. Lackey

[57] ABSTRACT

Transportation apparatus for transporting passengers between spaced landings, including a conveyor, a conveyor drive unit, a handrail, a handrail drive unit, and a handrail drive pulley. The conveyor drive unit includes first and second spaced sprockets, and a drive chain reeved about the sprockets which drives the conveyor. The handrail drive pulley and a predetermined one of the sprockets are separately journaled for independent rotation about a common axis, with a drive belt linking the handrail drive pulley and predetermined rotational elements of the handrail drive unit. The pulley is selectively engageable with the predetermined one of the sprockets, to drive the handrail in synchronism with the conveyor when they are engaged, and enabling the frictional forces resisting the movement of the handrail to be directly measured when they are not engaged.

3 Claims, 6 Drawing Figures

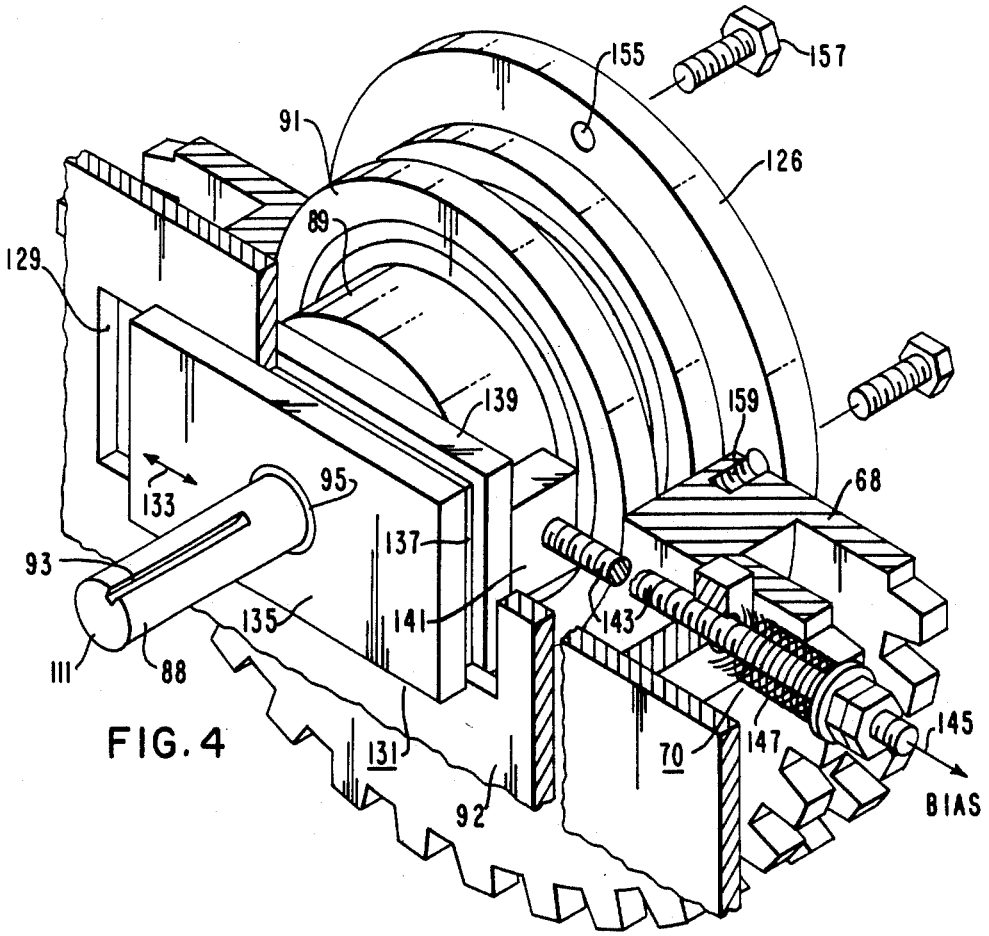
FIG. 4
FIG. 5
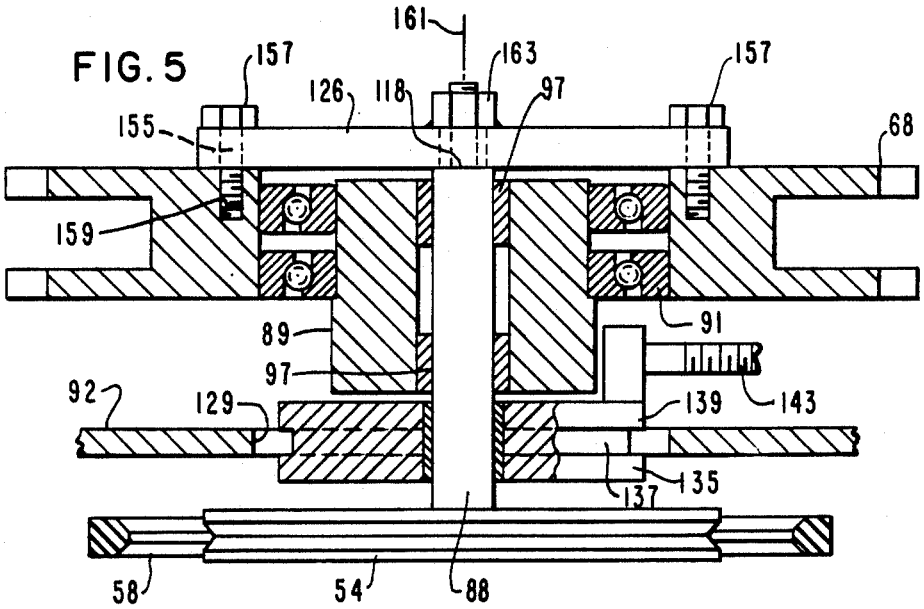

TRANSPORTATION APPARATUS

BACKGROUND OF THE INVENTION

1. Field of the Invention

The invention relates in general to transportation apparatus having movable handrails, and more specifically to transportation apparatus for transporting people between spaced landings, such as movable walks and escalators.

2. Description of the Prior Art

U.S. Pat. No. 3,712,447, which is assigned to the same assignee as the present application, discloses a handrail guide system for escalators and moving walks which eliminates the need for tensioning the handrail. A substantially continuous, closed-loop handrail guide system permits the handrail to be pushed as well as pulled about the guide loop. Suitable handrail drive arrangements for driving the handrail in such a system are disclosed in U.S. Pat. Nos. 3,414,109 and 3,779,360, which are assigned to the same assignee as the present application.

U.S. Pat. Nos. 3,707,220 and 3,677,388, which are assigned to the same assignee as the present application, disclose a modular passenger conveyor construction and a modular drive unit, respectively, with the latter being adapted for insertion into selected modular units of the former, in accordance with the requirement of the particular installation. The modular drive unit includes a sprocket on each side of the conveyor which is driven by an electric motor through a speed reducer. An idler sprocket is disposed on each side of the conveyor, adjacent to each driven sprocket, and a drive chain is reeved about each pair of driven and idler sprockets. The drive chain engages teeth on the conveyor to propel the conveyor about its closed loop.

A handrail drive pulley is mounted on an extension of the shaft of each driven sprocket, and a drive belt is reeved about this pulley and predetermined rotational elements of a handrail drive unit. Thus, the handrail on each side of the conveyor is driven in synchronism with the conveyor.

The handrail guide arrangement of U.S. Pat. No. 3,712,447 is carefully adjusted upon initial setup in an attempt to match its length with the length of the handrail loop, to reduce binding and frictional resistance of the handrail-guide interface. The loop length of the handrail may then change during usage due to manufacturing variations in the construction of the handrail, changes in the length of the handrail materials as the handrail flexes and wears, humidity, temperature, and the like. My U.S. Pat. No. 4,239,102 addresses this problem by disclosure of self-adjusting handrail apparatus, for accommodating temporary changes in loop length, such as those caused by humidity and temperature, reducing the frequency of readjustment of the handrail guide system. Thus, a smoothly operating handrail guide arrangement is provided when the handrail guide loop is correctly adjusted to provide low friction and freedom from binding, with the automatic adjustment accommodating temporary loop changes. It would be desirable to be able to quickly and accurately adjust the handrail guide loop to provide optimum low frictional resistance between the handrail and guide as the handrail is propelled about the guide loop.

SUMMARY OF THE INVENTION

Briefly, the present invention journals the handrail drive pulley for rotation on its own bearings, and selectively engages the handrail drive pulley with a predetermined sprocket of the conveyor drive unit. In a preferred embodiment of the invention, the idler sprocket is selected to drive the handrail pulley. It has been found that the idler sprocket provides a uniform driving source, notwithstanding its biased mounting arrangement, and the idler sprocket, being devoid of a drive shaft, lends itself to a rugged, simple, selective engagement with the handrail drive pulley. When the handrail guide arrangement is initially adjusted, the handrail drive pulley is disengaged from the associated sprocket. Means is provided on the pulley, or its associated shaft, for rotating the pulley with a torque wrench. Resistance to the rotational effort applied to the pulley is a direct measurement of the handrail-guide friction. Each handrail loop length will have a desired maximum torque wrench reading when the guide and handrail loop lengths are compatible, and there is no binding. A torque reading at or below the maximum value indicates proper adjustment. A reading which exceeds the allowable maximum indicates further adjustment is required.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 4 is a perspective view of the idler sprocket-handrail drive pulley arrangement shown in FIG. 3;

FIG. 5 is a cross-sectional view of the idler sprocket-handrail drive pulley arrangement shown in FIG. 4.

DESCRIPTION OF PREFERRED EMBODIMENTS

Figure 1:
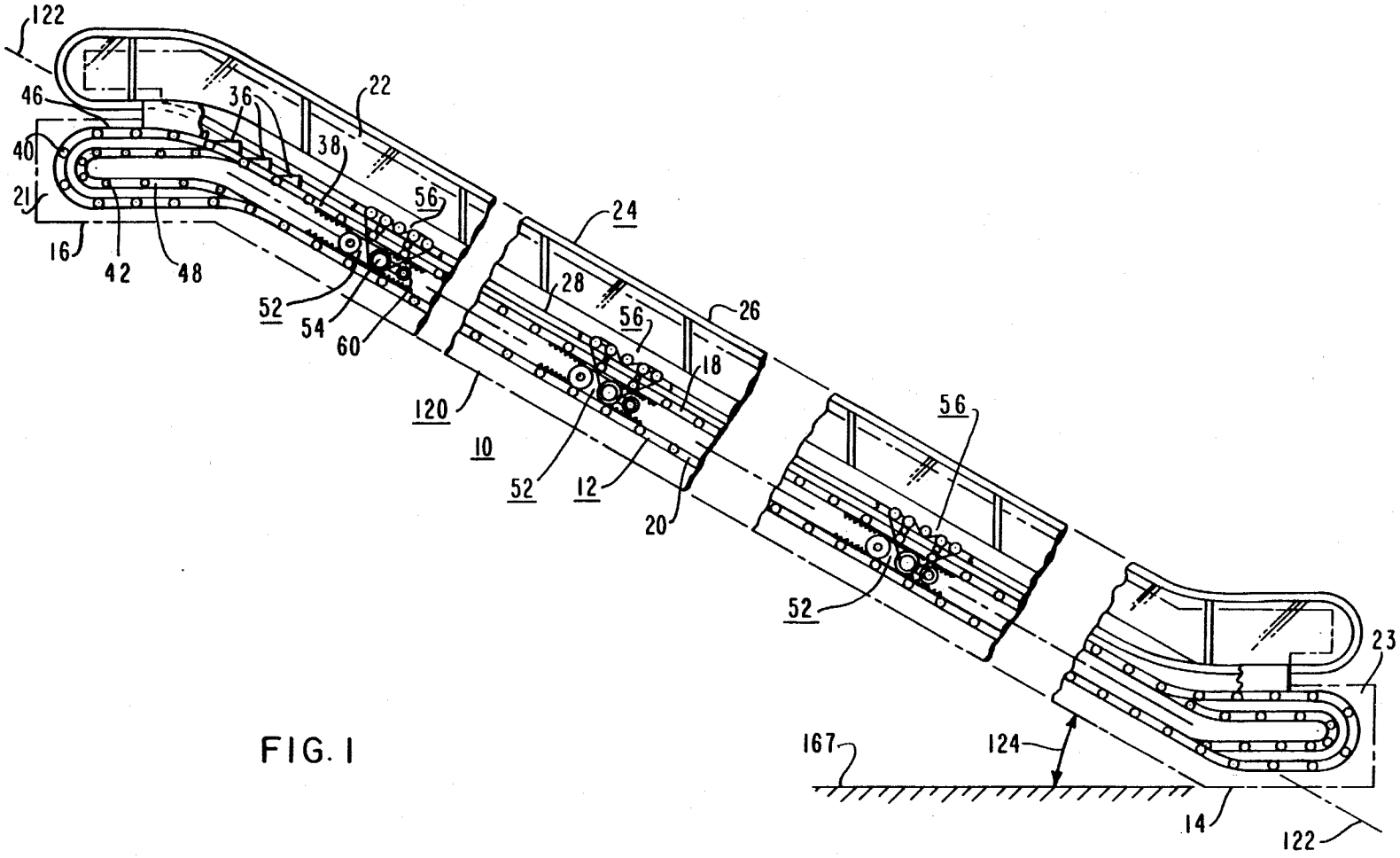
FIG. 1 is an elevational view of an escalator constructed according to the teachings of the invention.
Figure 2:
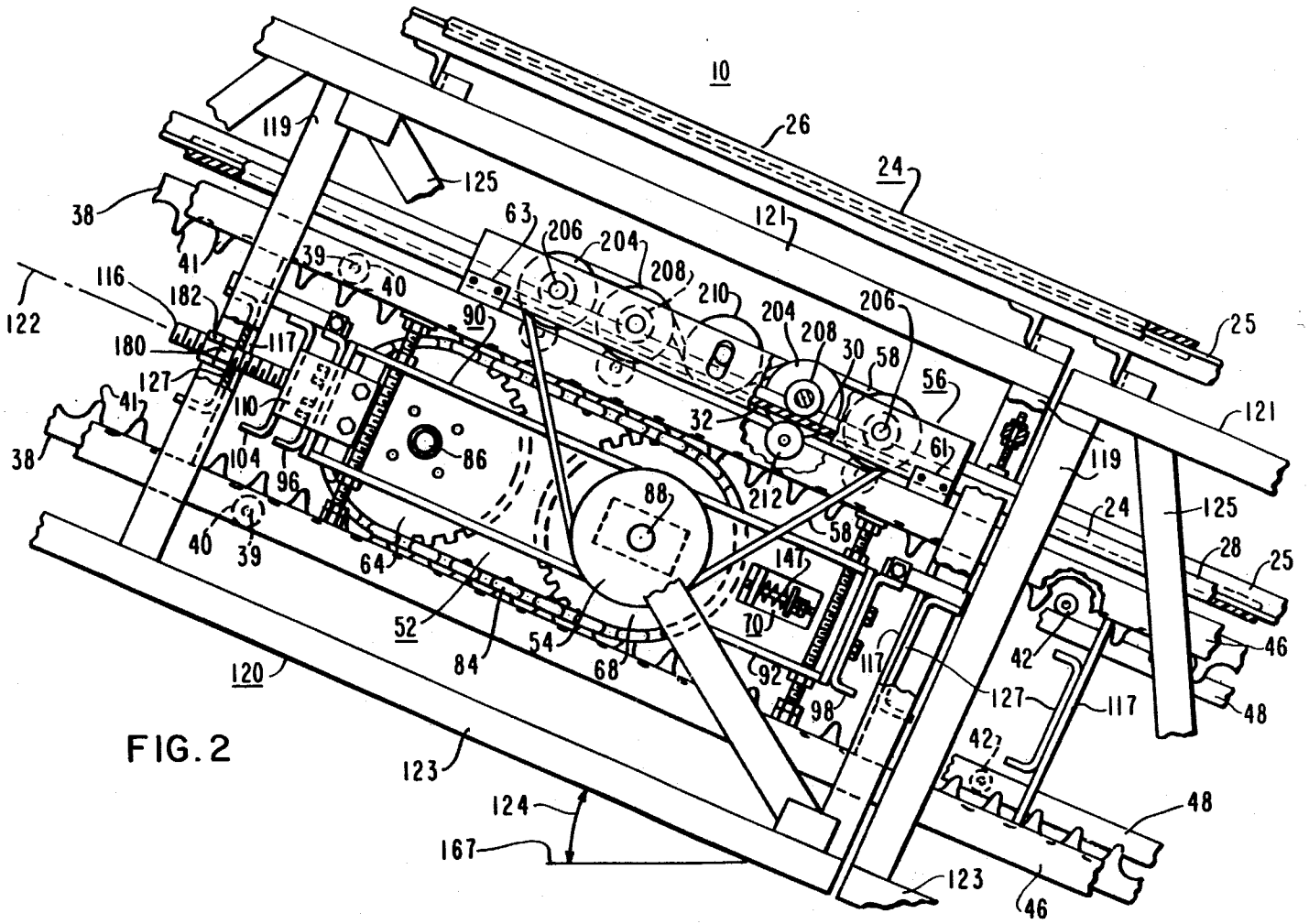
FIG. 2 is a fragmentary, elevational view of the escalator shown in FIG. 1, illustrating a conveyor drive unit, and a handrail drive unit, which may be used.

Referring now to the drawings, and to FIGS. 1 and 2 in particular, there is shown transportation apparatus 10 which utilize the teachings of the invention. While the invention is equally applicable to moving walkways, for purposes of example, it will be described relative to an escalator 10. FIG. 1 is a general view of escalator 10, in elevation, and FIG. 2 is a fragmentary, elevational view of a portion of the escalator 10. Escalator 10 is inclined from a horizontal plane 167 by a predetermined angle 124, such as an angle of 30°. Escalator 10 employs a conveyor portion 12 for transporting passengers between a first or lower landing 14 and a second or upper landing 16. Conveyor 12 is of the endless type, having an upper load bearing run 18 on which passengers stand while being transported between the landings, a lower run 20, and upper and lower turn-arounds 21 and 23, respectively, which interconnect the load bearing and return runs. While the invention may be utilized with any type of movable stairway which utilizes the substantially continuous stationary handrail guide arrangement disclosed in U.S. Pat. No. 3,712,447, its use is particularly advantageous with the modular passenger conveyor construction and modular drive unit construction disclosed in U.S. Pat. Nos. 3,707,220 and 3,677,388. Handrail drive units which may be used are shown in U.S. Pat. Nos. 3,414,109 and 3,779,360. Accordingly, in order to limit the length of the present application, all of these patents, which are assigned to the same assignee as the present application, and hereby incorporated into the present application by reference.

Conveyor 12 has first and second lateral sides, each of which are formed of rigid, pivotally interconnected step links 38, each of which have a plurality of teeth 41. The two sides of the conveyor 12 are interconnected by step axles 39, with a step 36 being connected to each step axle. The conveyor 12 is supported by guide and support rollers or wheels 40 which cooperate with guide tracks 46. The steps 36, in addition to being supported by the step axles 39 and rollers 40, are also supported and guided by trailer wheels or rollers 42 which cooperate with trailer guide tracks 48 to guide and support the steps as they move about the endless loop. One or more modular drive units, such as modular drive unit 52, engage the toothed links 38, to drive the conveyor 12 in either of its travel directions. In other words, conveyor 12 may be driven such that the steps 36 move up the incline on the load bearing run, or they may be driven in the opposite direction on the load bearing run, to cause the steps to move down the incline.

A ballustrade 22 is disposed above the conveyor 12, on each lateral side thereof, for supporting the upper run of a continuous, flexible handrail 24. Ballustrade 22 may be transparent, as indicated, or opaque, as desired. The handrail 24 is guided about a closed loop which includes an upper run 26 adjacent to the ballustrade 22, during which a surface of the handrail 24 may be grasped by passengers as they are transported along the conveyor 12, and it also includes a lower or return run 28. Handrail 24 has a substantially C-shaped cross-sectional configuration, having first and second substantially flat, parallel major opposed surfaces 30 and 32, respectively, shown in FIGS. 2 and 6, which define the major body portion of the handrail. Major side 30 is the inner side of the handrail, which rides on guide means, such as handrail guide member 25, and major side 32 is the outer side which provides the surface which is available for support by passengers during the upper run 26 of the handrail 24.

The handrail guide member 25 has a substantially T-shaped cross-sectional configuration, which is disposed within the C-shaped cross-section of the handrail 24. The handrail guide 25, on both the upper and lower runs of the handrail, as well as at the turn-arounds 21 and 23, is preferably continuous, at least to the extent that any gaps are bridged by the handrail 24 without significant lateral movement of the handrail, permitting the handrail to be pushed as well as pulled by the handrail drive means around the guide loop. As hereinbefore stated, this "continuous" guide concept of the handrail operation is disclosed in incorporated U.S. Pat. No. 3,712,447.

Figure 3:
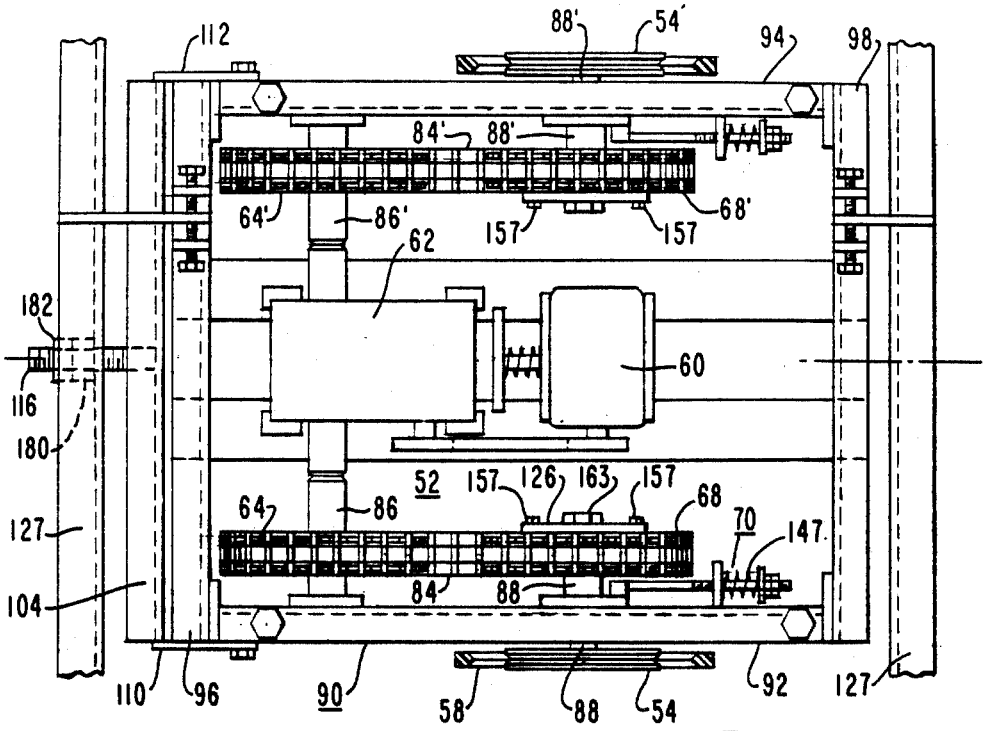
FIG. 3 is a plan view of the conveyor drive unit shown in FIG. 2.

Conveyor 12, and thus the steps 36, are driven by one or more drive units, depending upon rise, such as the single drive unit 52 illustrated. As shown in FIG. 3, which is a plan view of the drive unit 52 shown in FIGS. 1 and 2, drive unit 52 includes an electrical motor 60 which drives a pair of spaced drive sprockets disposed on opposite sides of conveyor 12, such as drive sprockets 64 and 64', via a gear reducer 62, a pair of spaced idler sprockets disposed on opposite sides of the conveyor 12, such as sprockets 68 and 68', and a pair of drive chains 84 and 84'. Each drive chain, such as drive chain 84, has three strands. Drive chain 84 is reeved about the drive and idler sprockets 64 and 68, respectively, with the outer two strands engaging teeth on the sprockets. The inner strand engages the teeth 41 of the links 38, to drive the conveyor 12.

Modular drive unit 52 includes a handrail drive pulley on each side of the conveyor 12, such as pulleys 54 and 54'. Each handrail drive pulley, such as pulley 54, drives a handrail drive unit disposed on its associated side of the conveyor 12, such as handrail drive unit 56 disposed on the side of pulley 54. As will be hereinafter explained, it is important that each pulley be journaled for rotation independent of its driving source.

FIG. 2 illustrates the invention applied to the specific escalator modular drive unit construction set forth in detail in my co-pending application Ser. No. 532,437, filed Sept. 15, 1983, entitled "ESCALATOR", but other arrangements may be used. As explained in detail in incorporated U.S. Pat. No. 3,707,220, escalator 10 includes a support truss 120. Truss 120 is preferably formed of a plurality of modules, with FIG. 2 setting forth an exemplary embodiment of a drive unit module. Construction of a module begins with the fabrication of right and left-hand sections. For each of such half sections, the upper and lower main tracks 46 and the upper and lower trailer tracks 48 are precisely aligned with respect to one another through rigid connection to precision templates 117. The templates 117 are provided at spaced intervals along the direction of travel of the transportation apparatus. The four track sections, held in rigid alignment by the templates 117, form track assemblies. The half sections are completed by welding truss pieces to the track assemblies. Vertical truss members 119 are welded to predetermined templates 117. Upper longitudinal truss members 121 and lower longitudinal truss members 123 and then welded to the ends of the vertical truss members 119. Added rigidity is given to the structure by diagonal truss members 125, which are welded to the upper and lower longitudinal truss members 121 and 123, respectively. The right and left-hand sections are then joined together by boxing channel members or beams 127, which are welded to predetermined templates 117.

Drive unit 52 includes a sturdy, rigid mounting frame 90. Frame 90 includes a pair of rigid side channel members, such as members 92 and 94, and front and rear rigid cross channel members 96 and 98, respectively. The adjacent ends of the side and cross channel members are secured together, such as by welding, to create a frame having a substantially rectangular configuration.

A deflection member or beam 104 is provided which is connected to the pair of side channel members 92 and 94 via mounting plate members 110 and 112. A sturdy threaded stud member 116 has one end fixed to substantially the midpoint of the deflection beam 104, and its other end extends through an opening in a cross beam 127. Nuts 180 and 182 may be engaged with stud 116, to secure frame 90 to the cross beam 127. In addition to fixing the drive unit 52 to the truss 120, the stud 116 and associated nuts function as a single adjustment point for moving the drive unit 52 along the inclined portion of the escalator.

Figure 6:
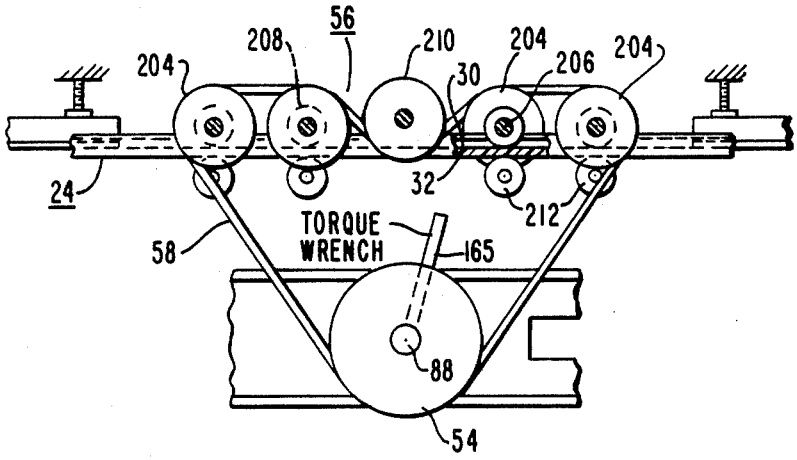
FIG. 6 is an elevational view of the handrail drive unit and handrail drive pulley, illustrating torque wrench measurement indicative of the handrail-guide friction.

Handrail drive unit 56 is shown in greater detail in FIGS. 2 and 6, which are elevational views of the driving and driven sides, respectively. For purposes of example, handrail drive unit 56 is illustrated as being constructed according to the drive unit of incorporated U.S. Pat. No. 3,779,360. Its support structure may be mounted on suitable truss elements, such as on guide track 46 via mounting brackets 61 and 63. Drive unit 56 includes a plurality of auxiliary drive pulleys or sprocket wheels 204 which are driven by the handrail drive pulley 54 and a drive belt or sprocket chain 58. While it would be possible for the handrail drive pulley 54 to be connected to be driven by the driven sprocket 64, in a preferred embodiment it is connected to be driven by the idler sprocket 68. In the prior art, it was thought mandatory that the handrail drive unit 56 be driven from the driven sprocket 64, as it was felt the idler sprocket 68 would not provide a smooth driving force. I have found, however, that the idler sprocket 68 provides as smooth a driving force as the driven sprocket 64, notwithstanding spring loading of the idler sprocket, and, as will be hereinafter explained, driving from the idler sprocket 68 provides many advantages.

Each auxiliary handrail drive pulley 204 may be toothed, and the sprocket chain or belt 58 may have cooperative teeth formed thereon of any suitable form. The sprocket chain may be a timing belt formed of metal, or of an elastomeric material having a metallic embedment which makes the belt substantially extensible. Each auxiliary handrail drive pulley 204 is keyed to one end of a shaft 206, which is journaled for rotation, and a traction or drive roller 208 is keyed to its opposite end. Thus, when auxiliary drive pulley 204 is rotated by the drive belt 58, a traction roller 208 on the same shaft 206 is also driven. Traction roller 208 is disposed such that a portion of its periphery or rim engages the inner surface 30 of the handrail 24.

A plurality of pairs of drive pulleys 204 and traction rollers 208 are provided at spaced intervals along a support channel 200, with the peripheries of the plurality of traction rollers 208 all falling on a line which coincides with the return run 28 of the handrail 24. After the drive belt 58 passes over the upper surfaces of a predetermined number of adjacent auxiliary drive pulleys 204, such as two, it may pass under a take-up pulley 210 after passing over the upper surfaces of the next group of auxiliary drive pulleys.

A plurality of pressure rollers 212 are provided, which are urged or biased against the surface 32 of the handrail 24, and towards a traction roller 208. The biasing means, for example, may include a leaf spring assembly (not shown). The traction and pressure rollers are provided in cooperative pairs, with each pair providing a driving point for squeezing and propelling the handrail 24 about its closed guide loop.

The idler sprockets 68 are spring biased to achieve and maintain desired tension in the drive chain 84. FIG. 4 is a fragmentary, perspective view setting forth an exemplary biasing arrangement 70 which may be used for each idler sprocket. More specifically, FIG. 4 illustrates a rectangular opening 129 formed in the web of side channel member 92, with an assembly 131 disposed to slide back and forth in the opening 129, in the direction of longitudinal axis 122, as indicated by double-headed arrow 133. Assembly 131 includes first, second and third plate members 135, 137 and 139, respectively, and a shaft 88, which may be the handrail drive pulley shaft, and a tubular support member 89. Plate members 135 and 139 are similarly dimensioned, and are larger than opening 129. Plate member 137, which is disposed between the first and third plate members, has a smaller dimension, sized to snugly extend through opening 129. As will be hereinafter explained, one end of shaft 88 extends through support member 89 and it is selectively engageable with the idler sprocket 68, to be turned with rotation of the idler sprocket. The idler sprocket 68 is journaled for rotation about support member 89 via bearings 91. A metallic block 141 is fixed to plate member 139, and a threaded shaft 143 is biased in the direction of arrow 145 by a compression spring 147 shown in FIG. 2.

Handrail drive pulley 54 is journaled for independent rotation via its own shaft 88, to which it may be keyed adjacent to an end 111 thereof via key slot 93. Shaft 88 is journaled for rotation in slidable assembly 131 via bearings 95. As shown in FIG. 5, which is a cross-sectional plan view of the assembly shown in FIG. 4, shaft 88 also extends through an opening in tubular support member 89, and is rotatably supported within the opening by bearings 97. The remaining end 118 of shaft 88 extends outwardly past the end of the tubular support member 89, and a circular plate member 126 is fixed thereto, such as by welding. Plate member 126 has a plurality of circumferentially spaced openings 155 therein for receiving bolts 157. Sprocket 68 has a plurality of threaded openings 159. Plate member 126, and thus pulley 54, is selectively engageable with idler sprocket 68, by inserting bolts 157 through openings 155 in plate member 126 and threadably engaging the bolts 157 with the threaded openings 159 in the sprocket 68. Thus, when the sprocket 68 is rotated by the drive chain 84, the handrail drive pulley 54 and the associated handrail drive unit 56 will be driven in synchronism with the modular drive unit 52 and conveyor 12.

It will be noted that sprocket 68 and pulley 54 are independently journaled for rotation on a common axis 161. A large nut 163 is welded to plate member 126, coaxial with axis 161. By removing bolts 157, pulley 54 may be rotated without any drag or frictional resistance due to sprocket 68. When multiple drive units are involved, only one handrail drive unit should be contacting the handrail at this time, i.e., the one associated with the pulley 54 to be rotated. Thus, by placing a torque wrench 165, shown in FIG. 6, on nut 163, the force required to turn pulley 54, as registered on the torque wrench 165, will be a direct measurement of the frictional resistance between the handrail 24 and its substantially continuous guide 25. The maximum allowable force will be known for the length of the handrail loop, and if the torque wrench indicates that the force is at or below this maximum value, it will be immediately known that the guide loop is properly adjusted. If the force required to turn pulley 54 is greater than the allowed maximum value, it will be immediately known that further adjustment is required. In other words, the handrail and guide are binding due to too small, or too large a guide loop, compared with the length of the handrail loop, and readjustment is necessary. It will also be noted that the driving arrangement of FIGS. 4 and 5 would not be possible if the driven sprocket 64 were to be used as the driving source, as the drive shafts 86 and 86' would be in the way. A relatively large amount of space is available adjacent to the idler sprocket 68, within the rectangular frame 90, for placement and turning of the torque wrench.

In summary, the present invention discloses new and improved transportation apparatus for transporting passengers between spaced landings, of the type which includes a handrail driven in synchronism with the conveyor portion of the apparatus. The handrail is supported and guided by a substantially continuous stationary guide arrangement, with proper adjustment thereof for minimum frictional resistance between the handrail guide and the handrail being easily determined by a selective engagement of the handrail drive pulley with its driving source. The handrail guide pulley is independently journaled for rotation, enabling it to be disconnected from its driving source, and means are provided on the pulley for rotating it with a torque wrench. The maximum allowable resistance for the handrail guide loop being tested will be known, and the simple torque wrench test will immediately indicate whether or not proper adjustment has been made. When the escalator is initially installed, the coupling between the handrail guide pulley and idler sprocket should not be completed until the proper guide loop adjustment has been made. Adjustments in guide loop length may then be made while one member of the installation team is manning the torque wrench, providing immediate feedback for other members of the installation team as to the effect of their guide loop adjustment.

I claim as my invention:

1. Transportation apparatus comprising:

a conveyor, conveyor drive means for driving said conveyor which includes a drive chain reeved about spaced first and second sprockets, substantially continuous, closed-loop handrail guide means on said conveyor, a handrail on the guide means, handrail drive means for driving the handrail, said handrail drive means including a plurality of sets of driven traction rollers and opposing pressure rollers spaced along said handrail to push and pull the handrail about said substantially continuous, closed-loop handrail guide means, means linking the conveyor drive means and the handrail drive means including a pulley on the conveyor drive means, and a handrail drive belt disposed to link the pulley and the driven traction rollers of the handrail drive means, first and second coaxial bearing means for separately journaling a predetermined one of said sprockets and pulley, respectively, for independent rotation, fastener means which is actuable to selectively interconnect and disconnect the pulley and said predetermined sprocket, to rotate the pulley with said predetermined sprocket when they are interconnected, means for attaching an operating means to said pulley, for independently rotating the pulley on its associated bearings when it is disconnected from said predetermined sprocket, to enable direct measurement of the force required to drive the handrail about the substantially continuous, closed-loop guide means and a shaft journaled for rotation by the second bearing means, with said shaft having one end connected to the pulley and its other end connectable with said predetermined one of said sprockets by said fastener means, with said predetermined on of said sprockets supported by said first bearing means.

2. In the transportation apparatus of claim 1, wherein the first and second sprockets are driven and idler sprockets, respectively, with the predetermined one of the sprockets being said idler sprocket.

3. In the transportation apparatus of claim 2, a stationary cylindrical support member having an opening extending between its ends, with the first bearing means being disposed about the outer surface of said support member, and with the second bearing means being disposed within the opening defined by said support member.

* * * * *